US010161212B2

(12) United States Patent
Araujo et al.

(10) Patent No.: US 10,161,212 B2
(45) Date of Patent: Dec. 25, 2018

(54) PACKER ASSEMBLY WITH MULTIPLE DIFFERENT INSERTS FOR BLOWOUT PREVENTER

(71) Applicant: Cameron International Corporation, Houston, TX (US)

(72) Inventors: Raul Araujo, Cypress, TX (US); Jeff Lambert, Tomball, TX (US)

(73) Assignee: Cameron International Corporation, Houston, TX (US)

( * ) Notice: Subject to any disclaimer, the term of this patent is extended or adjusted under 35 U.S.C. 154(b) by 95 days.

(21) Appl. No.: 14/950,225

(22) Filed: Nov. 24, 2015

(65) Prior Publication Data

US 2017/0145771 A1 May 25, 2017

(51) Int. Cl.
*E21B 33/06* (2006.01)

(52) U.S. Cl.
CPC ..... *E21B 33/062* (2013.01)

(58) Field of Classification Search
CPC ..... E21B 33/06–33/062
USPC ..... 251/1.1–1.3, 368; 277/325; 166/85.4, 166/364
See application file for complete search history.

(56) References Cited

U.S. PATENT DOCUMENTS 3,434,729 A * 3/1969 Vertson ..... E21B 33/062 137/315.02
3,572,627 A * 3/1971 Jones ..... E21B 33/06 251/1.2
3,572,628 A * 3/1971 Jones ..... E21B 33/06 251/1.2
3,917,293 A * 11/1975 Lewis ..... E21B 33/06 251/1.2
3,994,472 A * 11/1976 Williams ..... E21B 33/06 251/1.2
4,089,532 A * 5/1978 Kamyshnikov ..... E21B 33/062 251/1.3
4,099,699 A * 7/1978 Allen ..... E21B 33/06 251/1.2
4,229,012 A * 10/1980 Williams, III ..... E21B 33/06 251/1.3
4,332,367 A * 6/1982 Nelson ..... E21B 33/062 251/1.3

(Continued)

FOREIGN PATENT DOCUMENTS

EP 0471560 A1 2/1992

OTHER PUBLICATIONS

International Search Report and Written Opinion issued in corresponding PCT application No. PCT/US2016/062077, dated Mar. 3, 2017, 15 pgs.

(Continued)

*Primary Examiner* — John Bastianelli
(74) *Attorney, Agent, or Firm* — Helene Raybaud

(57) ABSTRACT

A blowout preventer ("BOP") includes a housing comprising a vertical bore extending through the housing and a packer assembly movably positioned within the housing and configured to form a seal within the housing. The packer assembly includes an elastomeric body comprising an elastomeric material, an exterior insert at least partially positioned within the elastomeric body, and an interior insert at least partially positioned within the elastomeric body to diminish extrusion of the elastomeric body when forming the seal.

20 Claims, 6 Drawing Sheets

(56) References Cited

U.S. PATENT DOCUMENTS 4,444,404 A * 4/1984 Parks, Jr. ..... E21B 33/062 251/1.2
4,458,876 A 7/1984 Schaeper et al.
4,553,730 A * 11/1985 Vicic ..... E21B 33/062 251/1.3
4,605,195 A 8/1986 Burton et al.
4,770,387 A * 9/1988 Granger ..... E21B 33/062 251/1.1
5,011,110 A * 4/1991 Le ..... E21B 33/062 251/1.1
5,013,005 A * 5/1991 Nance ..... E21B 33/062 251/1.3
5,064,164 A * 11/1991 Le ..... E21B 33/062 251/1.1
5,294,088 A * 3/1994 McWhorter ..... E21B 33/062 251/1.3
5,833,208 A * 11/1998 Lee, Jr. ..... E21B 33/062 251/1.1
5,851,013 A * 12/1998 Simons ..... E21B 33/06 251/1.2
6,367,804 B1 * 4/2002 Watts ..... E21B 33/062 251/1.2
6,857,634 B2 2/2005 Araujo
6,955,357 B2 * 10/2005 Griffin ..... E21B 33/062 251/1.2
6,974,135 B2 * 12/2005 Melancon ..... E21B 33/062 251/1.2
8,540,017 B2 * 9/2013 Ensley ..... E21B 33/062 166/84.4
2004/0021269 A1 * 2/2004 Gaudette ..... E21B 33/062 277/325
2008/0023917 A1 1/2008 Khandoker
2010/0243926 A1 * 9/2010 Weir ..... E21B 33/062 251/1.3
2010/0294482 A1 * 11/2010 Araujo ..... E21B 33/061 166/85.4
2012/0227987 A1 * 9/2012 Castriotta ..... E21B 33/062 166/387

OTHER PUBLICATIONS

International Preliminary Report on Patentability for the equivalent International patent application PCT/US2016/062077 dated Jun. 7, 2018.

* cited by examiner

PACKER ASSEMBLY WITH MULTIPLE DIFFERENT INSERTS FOR BLOWOUT PREVENTER

BACKGROUND

This section is intended to provide background information to facilitate a better understanding of the various aspects of the described embodiments. Accordingly, it should be understood that these statements are to be read in this light and not as admissions of prior art.

Blowout preventers (BOPs) are used extensively throughout the oil and gas industry. Typical BOPs are used as a large specialized valve or similar mechanical device that seal, control, and monitor oil and gas wells. The two categories of BOPs that are most prevalent are ram BOPs and annular BOPs. Blowout preventer stacks frequently utilize both types of BOPs, typically with at least one annular BOP stacked above several ram BOPs. The ram assemblies (i.e., rams) in ram BOPs allow for shearing drill pipe in the case of shear ram assemblies, sealing off around drill pipe in the case of pipe ram assemblies or variable bore ram assemblies, or sealing off the bore in the case of blind ram assemblies. Typically, a BOP stack may be secured to a wellhead and may provide a safe means for sealing the well in the event of a system failure.

A typical ram BOP includes a main body or housing with a vertical bore. Ram bonnet assemblies may be bolted to opposing sides of the main body using a number of high tensile fasteners, such as bolts or studs. These fasteners are required to hold the bonnet in position to enable the sealing arrangements to work effectively. One or more elastomeric sealing elements or "packers" may then be used to form a seal within the main body and against the ram assemblies. There are several configurations, but essentially they are all directed to preventing a leakage bypass between the mating faces of the ram assembly and the main body. Each bonnet assembly includes a piston that is laterally movable within a ram cavity of the bonnet assembly by pressurized hydraulic fluid acting on one side of the piston. The opposite side of each piston has a connecting rod attached thereto that in turn has a ram assembly mounted thereon.

The ram assemblies are designed to move laterally toward the vertical bore of the BOP to shear or seal off on any object located therein. For a shear ram BOP, the shear ram assemblies are used to shear or cut any object located in the vertical bore of the blowout preventer. Pipe ram assemblies and variable bore ram assemblies utilize seals or packers that close in on and seal off on a tubular within the vertical bore of the BOP, such as a section of drill pipe used during drilling operations. Blind ram assemblies also utilize seals, in which the ram assemblies close in and across the bore of the BOP when no object is present to seal across the bore.

The annular BOP utilizes an annular or a hemispherical piece of rubber usually reinforced with inserts. Unlike a ram-type BOP, which closes with a horizontal motion, an annular BOP closes inward around the drill string in a smooth simultaneous upward and inward motion to seal on the pipe or the open hole. The geometry of this movement reduces internal stresses and friction between the BOP body and the sealing element, which translates into a longer field life with less maintenance. The annular design may also operate with a much lower operating pressure, reducing the number of hydraulic accumulators necessary, and thereby reducing cost and complexity of the BOP.

Packers used for either a ram-type or annular BOPs can be designed to seal around pipe of a specific size in the BOP bore when the BOP is closed. Other packers though may be configured to seal around a range of pipe sizes, and are referred to as variable bore packers. Both packers form a pressure tight seal during a kick until the well bore pressure can be controlled.

To form a proper seal with a variable bore BOP, the packer material must be of a low enough durometer to close against the pipe and provide enough pressure for a range of pipe diameters. However, a low durometer also tends to make the packer suffer from lack of support during the loading process. Increased durometer packers may be used but more force is needed to form a seal, sometimes resulting in an inadequate seal due to incomplete closure and/or low pressure. Additionally, the increased durometer packers may not be able to seal against as wide a range of pipe diameters. With both the ram-type and annular variable bore BOPs, the packer typically includes an annular or two semi-circular elastomeric sealing elements with an array of support inserts embedded in the elastomeric material. The inserts are molded within the elastomeric material in a pattern around the opening of the elastomeric material, forming unitary structure. The structure allows the plurality of packer inserts to move and seat against different diameter tubular members and also helps prevent extrusion of the elastomeric material between the packer inserts and the tubular member.

Even with inserts, however, some packers still have durability issues. Although inserts help prevent extrusion, the inserts still include gaps between the insert tips and the pipe when the packer is actuated. When subject to load, the packer elastomeric material may still extrude through these small gaps, causing the packer material to tear and break apart and thus lose ability to form an adequate seal.

DESCRIPTION OF THE DRAWINGS

For a detailed description of the embodiments of the invention, reference will now be made to the accompanying drawings in which.

DETAILED DESCRIPTION

Figure 1:
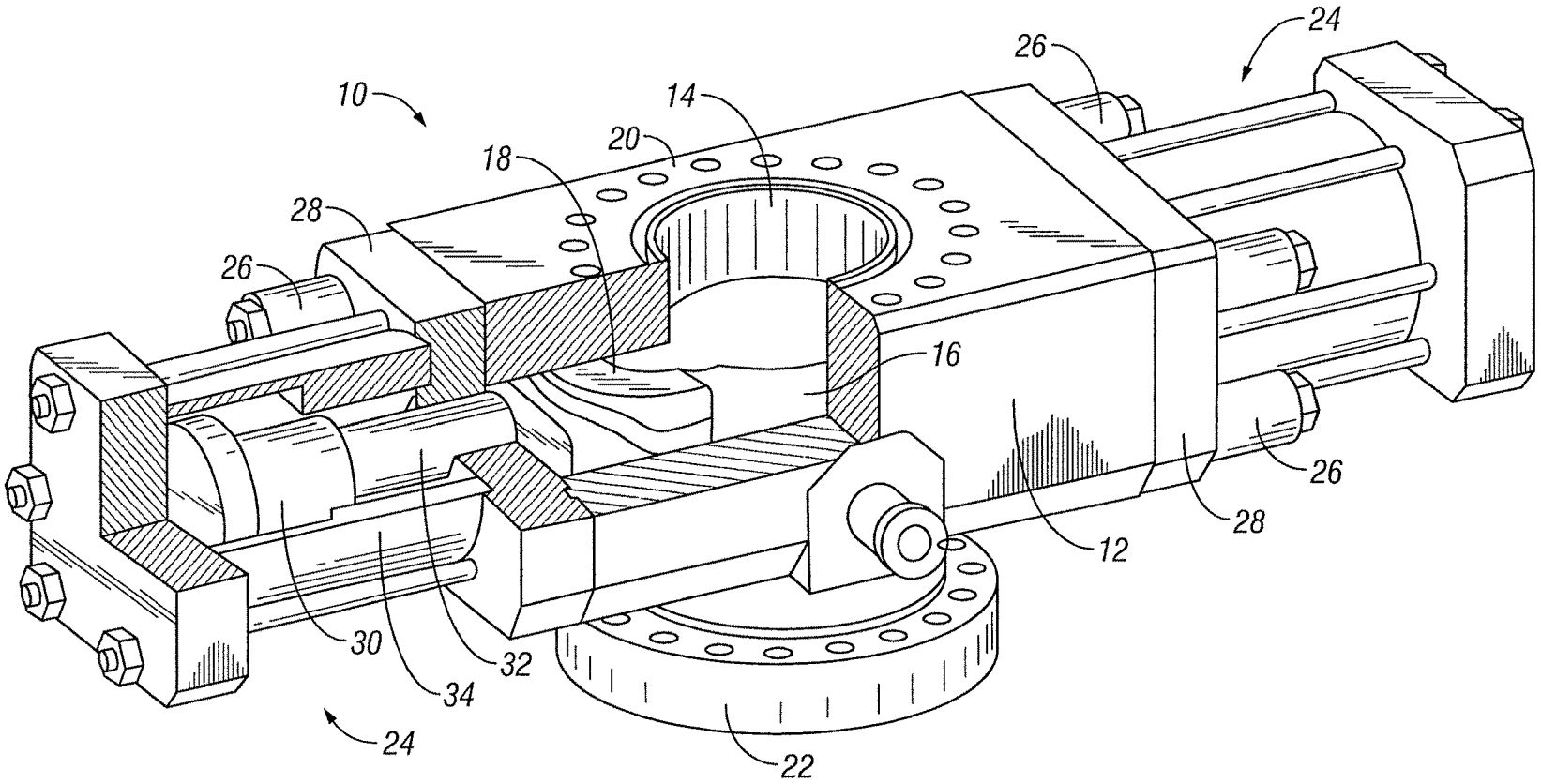
FIG. 1 depicts a sectional view of a ram blowout preventer, according to one or more embodiments.

The present disclosure may be used within a BOP, such as ram BOP and/or an annular BOP. Accordingly, referring now to FIG. 1, a sectional view of a ram BOP 10 in accordance with one or more embodiments of the present disclosure is shown. The BOP 10 includes a housing 12, such as a hollow body, with a (e.g., vertical) bore 14 that enables passage of fluid or an object (e.g., tubular member) through the BOP 10. The housing 12 further includes one or more cavities 16, such as cavities 16 opposed from each other with respect to the bore 14, with a ram assembly 18 movably positioned within each cavity 16. The BOP 10 may be coupled to other equipment that facilitates natural resource production. For instance, production equipment or other components may be attached to the top of the BOP 10 using a connection 20 (which may be facilitated in the form of fasteners), and the BOP 10 may be attached to a wellhead or spool using the flange 22 and additional fasteners.

One or more bonnet assemblies 24 are secured to the housing 12 and include various components that facilitate control of the ram assemblies 18 positioned in the BOP 10. The bonnet assemblies 24 are coupled to the housing 12 by using one or more fasteners 26 to secure the bonnets 28 of the bonnet assemblies 24 to the housing 12. The ram assemblies 18 are then actuated and moved through the cavities 16, into and out of the bore 14, by operating and moving a piston 30 and a rod 32 coupled thereto within a housing 34 of the bonnet assemblies 24. In operation, a force (e.g., from hydraulic pressure) may be applied to the pistons 30 to drive the rods 32, which in turn drives the ram assemblies 18 coupled thereto into the bore 14 of the BOP 10. The ram assemblies 18 cooperate with one another when driven together to seal the bore 14 and inhibit flow through the BOP 10. For example, the ram assemblies 18 may be pipe ram assemblies, as shown, such that the pipe ram assemblies seal about a pipe or tubular member present within the bore 14 of the BOP housing 12.

Figure 2:
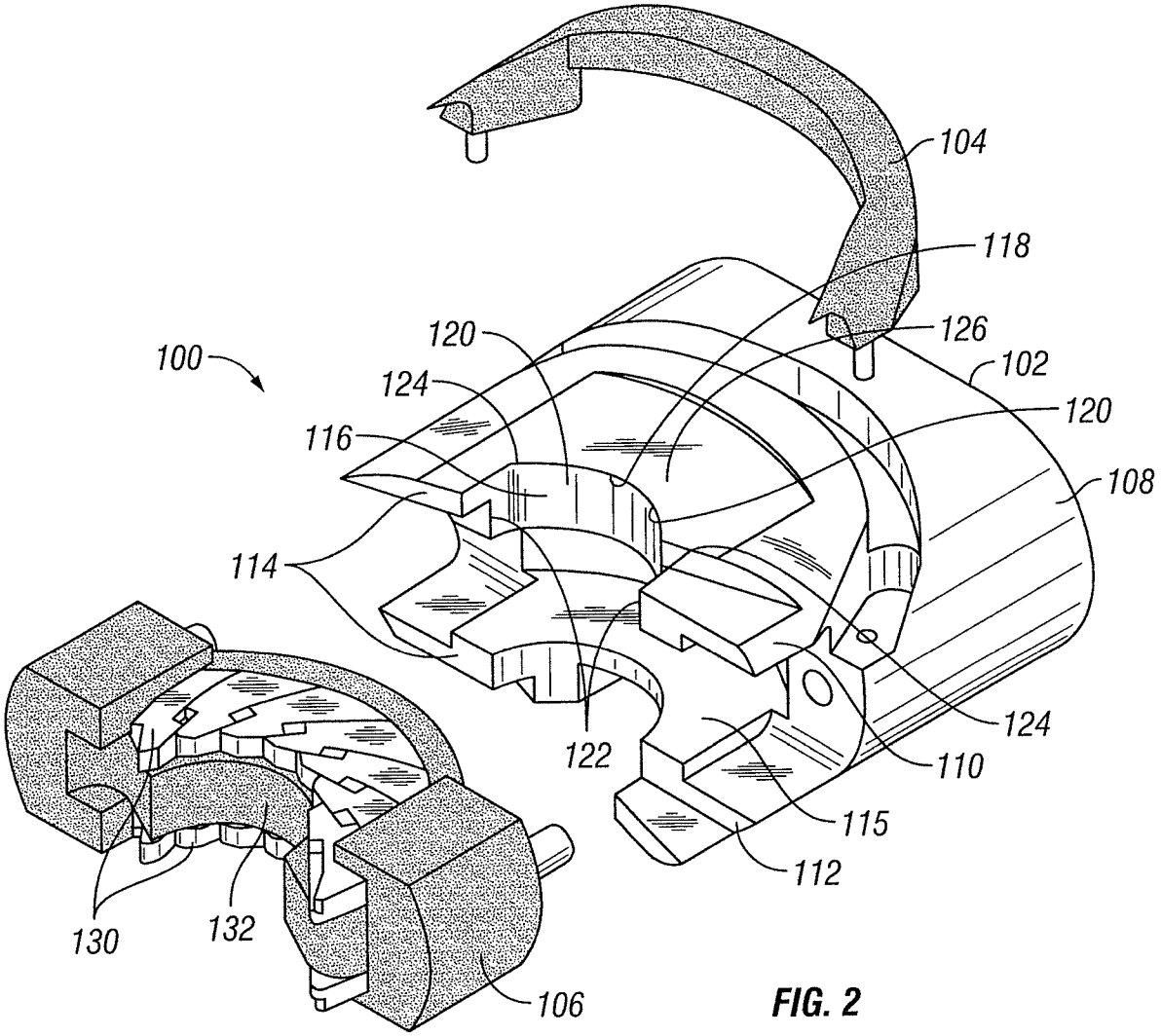
FIG. 2 depicts an exploded view of a variable bore ram packer assembly, according to one or more embodiments.

More particularly, in one or more embodiments, the ram assemblies 18 may be variable bore ram assemblies. For example, FIG. 2 shows an exploded view of a variable bore ram packer assembly 100 in accordance with one or more embodiments of the present disclosure. The variable bore ram packer assembly 100 includes a ram body 102, a top seal 104, and a variable bore packer assembly 106. The variable bore packer assembly 106 may include one or more inserts 130 positioned within an elastomeric element or body 132, in which the inserts 130 provide support to the elastomeric body 132 during sealing engagement (e.g., against a tubular member). In particular, the inserts 130 may provide support to the elastomeric body 132 during sealing engagement when the variable bore packer assembly 106 is sealing against objects or tubular members of different sizes. Further, the top seal 104 may include an elastomeric element or body that may provide sealing engagement between the ram body 102 and the cavity 16 of the BOP housing 12.

The ram body 102 is a generally rectangular parallelepiped shape with rounded sides 108 that fit in the cavities 16 of the BOP housing 12. The ram body 102 includes an upper body 110 and a lower body 112 connected by a front face 114 and to define a ram packer cavity 115 therebetween. A ram bore profile 116 is formed within the front face 114, in which the ram bore profile 116 may be substantially U-shaped or semi-annular shaped and extend vertically through the upper body 110 to the ram packer cavity 115.

The ram bore profile 116 may further be characterized by a rear portion 118, diverging sides 120, and a front throat 122. The rear portion 118 is shown as an arcuate segment connected to the front throat 122 by the diverging sides 120. The front throat 122 intersects the front face 114 at a substantially perpendicular angle, and the arcuate sections 124 connect to the diverging sides 120. The area 126 adjacent the ram bore profile 116 may be hardened by suitable means as weld inlay or thermal treatment to increase the load carrying capacity of ram bore profile 116.

Figure 3A:
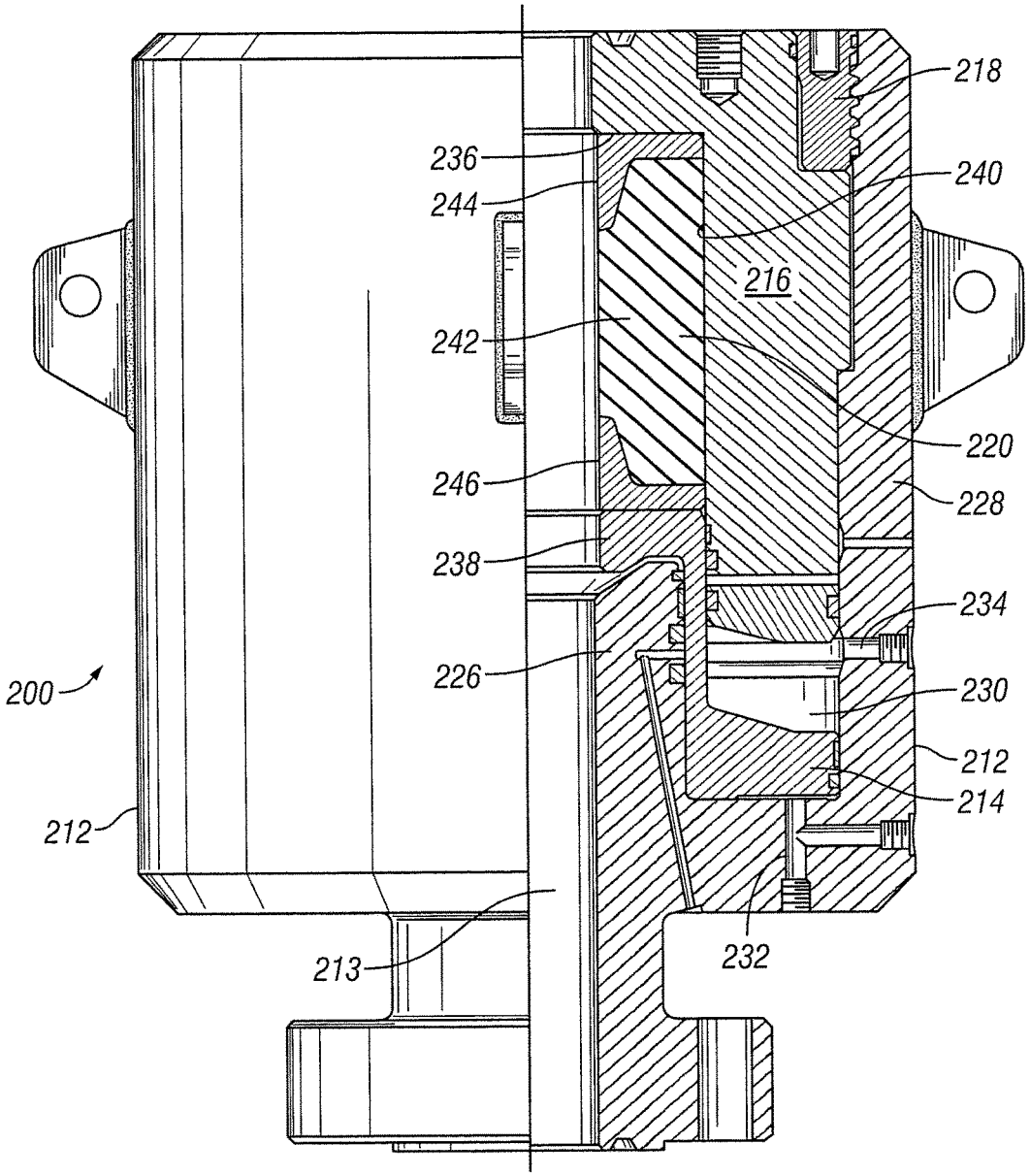
FIGS. 3A and 3B depict a sectional views of an annular blowout preventer, according to one or more embodiments.
Figure 3B:
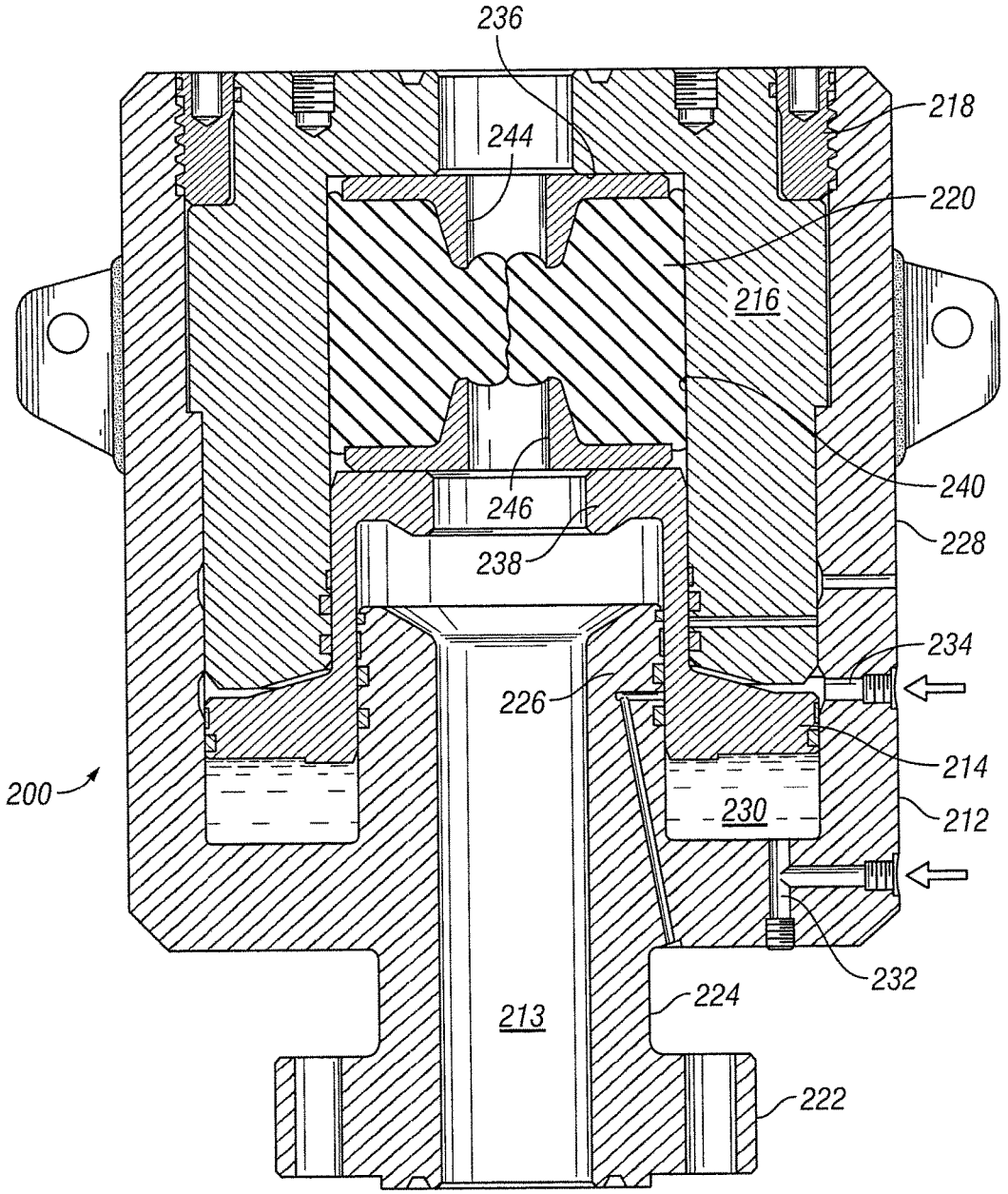

Referring now to FIGS. 3A and 3B, multiple sectional views of an annular BOP 200 in accordance with one or more embodiments of the present disclosure is shown. In particular, FIG. 3A shows the annular BOP 200 in an open position to enable fluid flow therethrough, and FIG. 3B shows the annular BOP 200 in a closed position to seal and prevent fluid flow therethrough.

The annular BOP 200 includes an annular housing 212 with a vertical bore 213 therethrough, an annular piston 214, a retainer ring 216, a lock ring 218, and a packer 220. The housing 212 includes a lower flange 222 connected by a neck 224, an annular rim 226 extending upwardly from the neck 224, and an exterior annular housing section 228 that extends radially outward from the neck 24 and upwardly around and spaced from the rim 226. A chamber 230 is the annular space between the rim 226 and the section 228 below the lower end of the retainer ring 216. The piston 214 is movably positioned partially within the chamber 230, as shown. A passage 232 extends through the housing section 228 into the chamber 230 to deliver fluid under pressure to the lower side of the piston 214, causing the piston 214 to move upward, and then to exhaust fluids as the piston 214 moves downward. A passage 234 extends through the housing section 228 into the chamber 230 to deliver fluid under pressure to the upper side of the piston 214, causing the piston 214 to move downward, and to exhaust fluids as the piston 214 moves upward.

The packer 220 is annular in shape, as hereinafter described, and is positioned within the recess under a shoulder 236 of the retainer ring 216, and is engaged on its lower end by an annular arm 238 of the piston 214. Thus, as the piston 214 moves upward, the arm 38 exerts an axial force on the packer 220. The shoulder 236 prevents upward movement of the packer 220 and an inner surface 240 of the retainer ring 216 prevents radial outward movement of the packer 220 when the packer 220 is moved to the closed or sealed position. The packer 220, as shown, may include an annular body 242, an upper circular series of inserts 244 arranged on, bonded to, and/or embedded in the upper surface of the body 242, and a lower circular series of rigid inserts 246 arranged on, bonded to, and/or embedded in the lower surface of the body 242.

Accordingly, disclosed herein are a BOP apparatus and/or a packer assembly for a BOP apparatus. As shown above, the BOP may be a ram BOP, such as a variable bore ram BOP, or an annular BOP. The packer assembly is then used within the BOP to facilitate forming a seal within the BOP. For example, the packer assembly may be used to form a seal about an object positioned within the BOP, or may be used to form a seal about itself when no object is positioned within the BOP. The packer assembly includes an elastomeric body with multiple inserts positioned within the elastomeric body to provide support to the elastomeric body when forming the seal. The inserts then include at least one exterior insert and one interior insert, in which the interior insert may be used to help prevent or diminish extrusion or deterioration of the elastomeric body, particularly when sealing.

Figure 4:
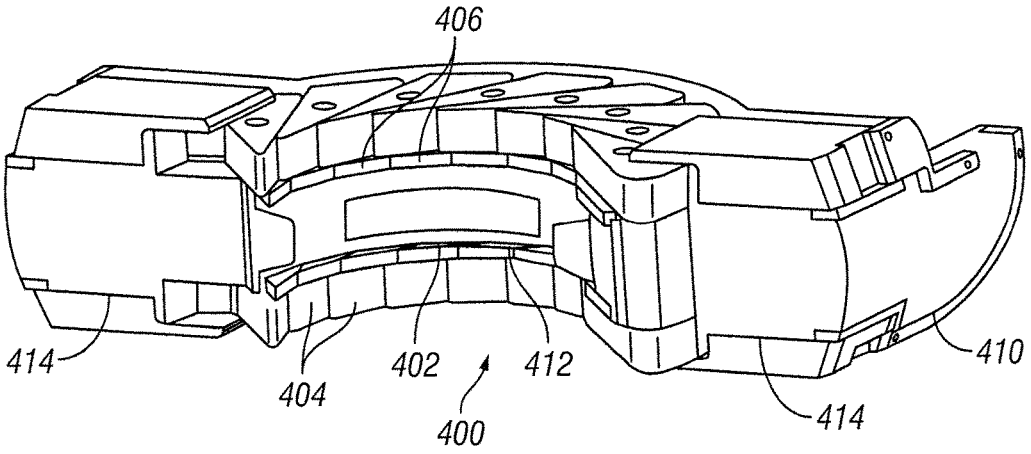
FIG. 4 depicts a side perspective view of a packer assembly including an elastomeric body, according to one or more embodiments.
Figure 5:
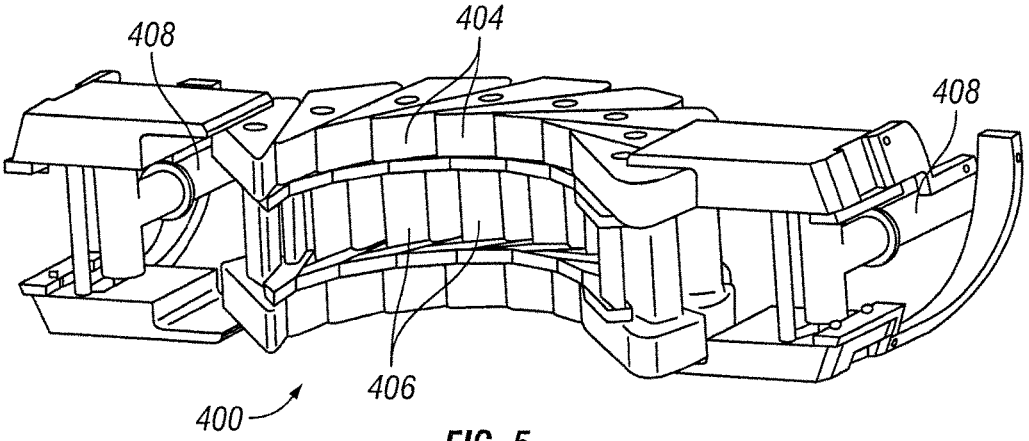
FIG. 5 depicts a side perspective view of a packer assembly with the elastomeric body removed, according to one or more embodiments.
Figure 6:
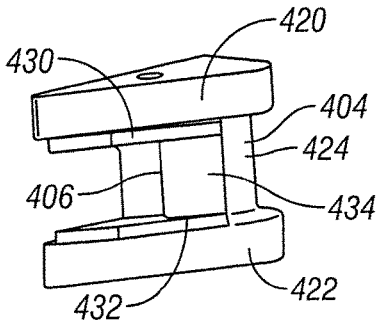
FIG. 6 depicts a side perspective view of an exterior insert and an interior insert when arranged and positioned within a packer assembly, according to one or more embodiments.

Referring now to FIGS. 4-6, multiple perspective views of a packer assembly 400 in accordance with one or more embodiments of the present disclosure are shown. In particular, FIG. 4 shows a side perspective view of the packer assembly 400 including an elastomeric body 402, FIG. 5 shows a side perspective view of the packer assembly 400 with the elastomeric body 402 removed, and FIG. 6 shows a side perspective view of an exterior insert 404 and an interior insert 406 when arranged and positioned within the packer assembly 400.

As shown, the packer assembly 400 includes the elastomeric body 402, in which the elastomeric body 402 may be formed from or include an elastomeric material (e.g., natural or synthetic rubber). The packer assembly 400 includes exterior inserts 404 (e.g., larger or primary inserts) and interior inserts 406 (e.g., smaller or secondary inserts) positioned within and molded into elastomeric body 402. The elastomeric body 402 may include a semi-annular shape (or annular shape in other embodiments, such as for an annular BOP) such that an axis of elastomeric body 402 or packer assembly 400 is collinear or coaxial with an axis of the bore of a BOP housing. The exterior inserts 404 are then positioned radially about the axis of the packer assembly 400. Similarly, the interior inserts 406 are positioned radially about the axis of the packer assembly 400.

In this embodiment, the packer assembly 400 may include one or more packer pins 408 positioned or molded into the elastomeric body 402 for connecting the packer assembly 400 to a ram assembly. The elastomeric body 402 may be formed or molded to include side block seals 410 on its lateral edges. The elastomeric body 402 may be molded into a semi-elliptical shape with a front sealing face 412, and then side sealing faces 414 at each edge, adjacent the side block seals 410. In an embodiment in which the packer assembly is used within an annular BOP, the packer assembly may not include the packer pins 408, side block seals 410, front sealing faces 412, and/or the side sealing faces 414. Further, in such an embodiment, the packer assembly may have an annular shape with a bore extending through the packer assembly.

As mentioned above, the packer assembly 400 includes one or more exterior inserts 404 and one or more interior inserts 406. In an embodiment including more than one exterior insert 404 and interior insert 406, there may be the same number of exterior inserts 404 and interior inserts 406. Further, as the exterior insert 404 is larger than the interior insert 406, one or more dimensions of the exterior insert 404 is then larger than that of the interior insert 406. For example, the exterior insert 404 may have a larger width, height, length, and/or depth than that of the interior insert 406. As best shown in FIG. 6, the exterior insert 404 has a larger width, height, and length than the interior insert 406 in this embodiment.

The exterior insert 404 includes a top support 420 (e.g., top plate), a bottom support 422 (e.g., bottom plate), and a central support 424 (e.g., central web). The top support 420 and the bottom support 422 may be substantially triangular in shape with the central support 424 positioned therebetween. The central support 424 extends between the top support 420 and the bottom support 422 to connect the top support 420 and the bottom support 422. The central support 424 may be integrally formed with the top support 420 and the bottom support 422, such as by casting, or the central support 424 may be formed separate from the top support 420 and the bottom support 422 and then later coupled or attached, such as by welding. The central support 424 is shown having an elongated rectangular cross section, but differently shaped cross sections would be suitable provided they give sufficient bending strength to the insert 404.

Similarly, the interior insert 406 includes a top support 430, a bottom support 432, and a central support 434. The central support 434 extends between the top support 430 and the bottom support 432 to connect the top support 430 and the bottom support 432. The central support 434 may be integrally formed with the top support 430 and the bottom support 432, or the central support 434 may be formed separate from the top support 430 and the bottom support 432 and then later coupled or attached. As with the above, the central support 434 is shown having an elongated rectangular cross section, but differently shaped cross sections may be suitable.

The inserts 404 and 406 may be positioned within the elastomeric body 402 such that the interior insert 406 is positioned (e.g., axially) between the top support 420 and the bottom support 422 of the exterior insert 404. For example, the axial position (with respect to an axis of the packer assembly 400 or the BOP housing) of the interior insert 406 may be at least partially between the top support 420 and the bottom support 422 of the exterior insert 404.

Further, the interior insert 406 may be positioned adjacent to the exterior insert 404 such that the interior insert 406 abuts or engages the exterior insert 404, particularly when the packer assembly 400 closes or seals about an object or itself. In this embodiment, the interior insert 406 is adjacent the exterior insert 404 such that the top support 430 of the interior insert 406 abuts the top support 420 of the exterior insert 404, and the bottom support 432 of the interior insert 406 abuts the bottom support 422 of the exterior insert 404. When opening or closing the packer assembly 400, the top support 430 of the interior insert 406 may engage and slide against the top support 420 of the exterior insert 404, and the bottom support 432 of the interior insert 406 may engage and slide against the bottom support 422 of the exterior insert 404.

The interior insert 406 is also positioned radially closer to the bore of a BOP housing or axis of the packer assembly 400 than the exterior insert 404. For example, the interior insert 406 may be positioned radially closer to the bore of the BOP housing such that a portion of the interior insert 406 extends out from the overhead profile of the exterior insert 404. This arrangement may enable interior insert 406 to then protrude and support the elastomeric body 402 to cover any gaps that may exist between the exterior insert 404 and an object sealed upon by the packer assembly 400.

In one or more embodiments, a packer assembly in accordance with the present disclosure is movable between an open position to allow fluid flow through a bore of a BOP housing and a closed position to form the seal within the BOP housing and prevent fluid flow through the bore. For example, the packer assembly may be used to form a seal about an object (if present) positioned within the bore of the BOP housing. Such an object may have different shapes, sizes, thicknesses, and other dimensions and properties, in which an object may include a drill pipe joint, a casing joint, a tool joint, or a wireline. For example, FIGS. 7 and 8 show the exterior inserts 404 and the interior inserts 406 of a packer assembly used to seal about tubular members having different sizes.

Figure 7:
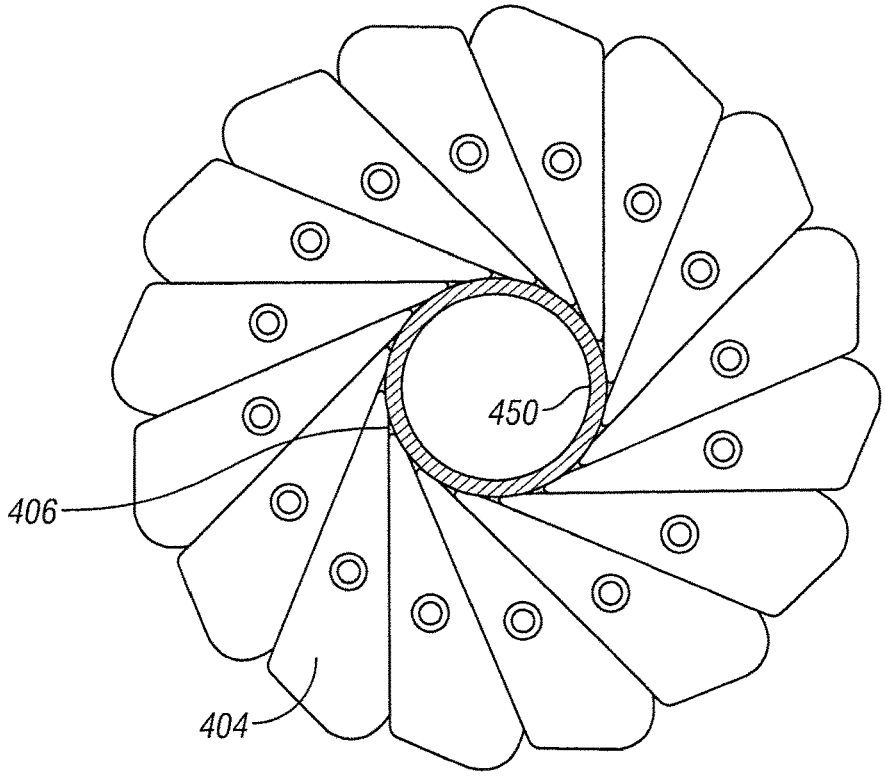
FIG. 7 depicts an above view of exterior inserts and interior inserts of a packer assembly used to seal about a tubular member, according to one or more embodiments.
Figure 8:
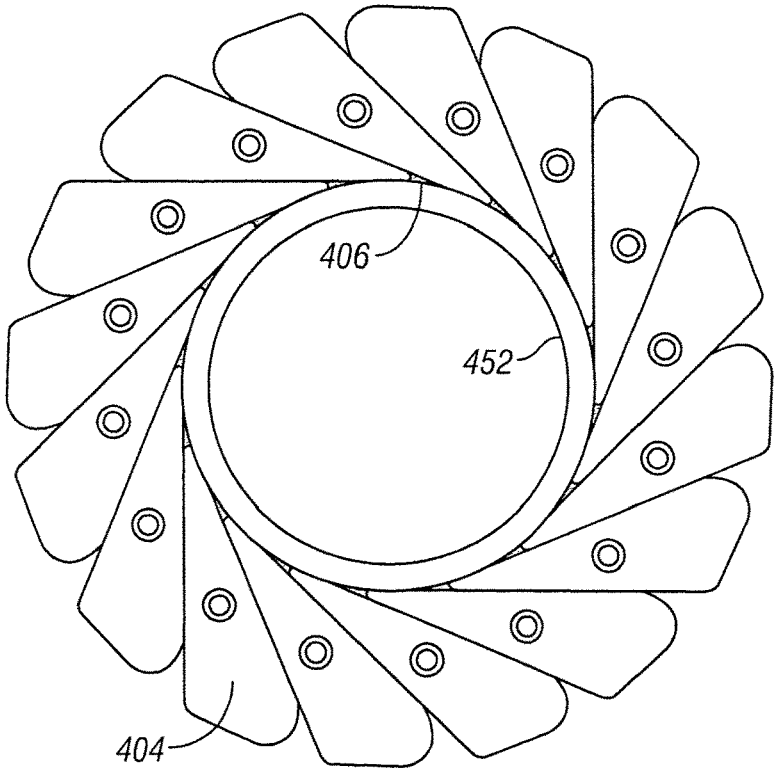
FIG. 8 depicts an above view of exterior inserts and interior inserts of a packer assembly used to seal about a tubular member, according to one or more embodiments.

FIG. 7 shows the packer assembly used to seal about a drill pipe 450 having a diameter of about 3.5 inches (about 8.9 cm), and FIG. 8 shows the same packer assembly used to seal about a drill pipe 452 having a diameter of about 7.625 inches (about 19.4 cm). The exterior inserts 404 (i.e., primary inserts) of the packer assembly are used to slide and rotate about the drill pipes 450 and 452, such as similar to that of an "iris" shutter of a camera, to contain and limit the flow of the elastomeric material of the elastomeric body around the drill pipes 450 and 452.

During this movement, small gaps may exist between the drill pipes 450 and 452 and the exterior inserts 404 of the packer assembly when adjusting to these different-sized drill pipes 450 and 452. Accordingly, the interior inserts 406 (i.e., secondary inserts) of the packer assembly may eliminate these small gaps. The interior inserts 406 slide and rotate about the drill pipes 450 and 452, also similar to that of an "iris" shutter of a camera, to contain and limit the flow of the elastomeric material of the elastomeric body around the drill pipes 450 and 452, and particularly in the small gaps between the exterior inserts 404 and the drill pipes 450 and 452. The interior inserts 406 move in unison with the exterior inserts 404, and may move with respect to the exterior inserts 404, to seal off and contain areas where the elastomeric material can flow out of the packer assembly, thereby preventing or diminishing extrusion of the of the elastomeric body. The elastomeric body life expectancy for the packer assembly may therefore be increased.

As shown and discussed above, a packer assembly in accordance with the present disclosure may be used within a ram BOP, such as by having a packer assembly positioned upon a ram assembly that is movable into and out of a bore of a BOP housing. In another embodiment, a packer assembly in accordance with the present disclosure may be included within an annular BOP. For example, the elastomeric body of the packer assembly may include an annular shape (as opposed to only a semi-annular shape) with the exterior inserts and interior inserts positioned within the annular body. The inserts of the packer assembly may then have a similar arrangement to those shown in FIGS. 7 and 8 when in the closed position.

In one or more embodiments, the interior insert and the exterior insert of the packer assembly may include or be formed from different materials. For example, the interior insert may include or be formed from a softer metal than that of the exterior insert, such as to facilitate the interior insert conforming to and forming a seal about an object when closing upon an object. In one example, the interior inserts may include or be formed from copper, or a softer copper material, than that of the exterior inserts. However, the exterior insert and the interior insert may also be formed from the same materials.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A packer assembly to form a seal within a blowout preventer ("BOP") while the BOP is in a closed position, the packer assembly comprising:

an elastomeric body comprising an elastomeric material;

an exterior insert at least partially positioned within the elastomeric body; and an interior insert at least partially positioned within the elastomeric body, wherein at least a portion of the interior insert is positioned radially closer to an object positioned in the vertical bore compared to a portion of a first plate of the exterior insert to enable the portion of the interior insert to block extrusion of the elastomeric body into a gap defined by and extending radially between the portion of the first plate of the exterior insert and the object while the BOP is in the closed position, and the interior insert is movable with respect to the exterior insert.

2. The packer assembly of claim 1, further comprising:

a plurality of exterior inserts positioned within the elastomeric body; and a plurality of interior inserts positioned within the elastomeric body.

3. The packer assembly of claim 1, wherein the elastomeric body comprises at least a semi-annular body formed about an axis.

4. The packer assembly of claim 3, wherein:

the exterior insert comprises a top support, a bottom support, and a central support extending between the top support and the bottom support; and the interior insert comprises a respective axial height that is less than a respective axial height of the exterior insert that enables the interior insert to be axially positioned between the top support and the bottom support of the exterior insert.

5. The packer assembly of claim 1, wherein the interior insert is configured to slide against the exterior insert as the BOP moves toward the closed position.

6. The packer assembly of claim 5, wherein the exterior insert and the interior insert are configured to rotate circumferentially about the object as the BOP moves toward the closed position.

7. A blowout preventer ("BOP"), comprising:

a housing comprising a vertical bore extending through the housing; and a packer assembly movably positioned within the housing and configured to form a seal within the housing while the BOP is in a closed position, the packer assembly comprising:

an elastomeric body comprising an elastomeric material;

an exterior insert at least partially positioned within the elastomeric body; and an interior insert at least partially positioned within the elastomeric body, wherein at least a portion of the interior insert is positioned radially closer to an object positioned in the vertical bore compared to a portion of a first plate of the exterior insert to enable the portion of the interior insert to block extrusion of the elastomeric body into a gap defined by and extending radially between the portion of the first plate of the exterior insert and the object while the BOP is in the closed position, and the interior insert is movable with respect to the exterior insert.

8. The BOP of claim 7, wherein the exterior insert comprises a larger insert and the interior insert comprises a smaller insert.

9. The BOP of claim 7, further comprising:

a plurality of exterior inserts at least partially positioned within the elastomeric body; and a plurality of interior inserts at least partially positioned within the elastomeric body.

10. The BOP of claim 7, wherein:

the exterior insert comprises a top support, a bottom support, and a central support extending between the top support and the bottom support; and the interior insert comprises a respective axial height that is less than a respective axial height of the exterior insert that enables the interior insert to be at least partially positioned axially between the top support and the bottom support of the exterior insert.

11. The BOP of claim 10, wherein:

the interior insert comprises a top support, a bottom support, and a central support extending between the top support of the interior insert and the bottom support of the interior insert;

the top support of the interior insert is positioned to abut the top support of the exterior insert; and the bottom support of the interior insert is positioned to abut the bottom support of the exterior insert.

12. The BOP of claim 7, wherein the interior insert comprises a different material than the exterior insert.

13. The BOP of claim 11, wherein the interior insert comprises a softer metal than the exterior insert.

14. The BOP of claim 7, wherein the BOP is movable between an open position to allow fluid flow through the vertical bore and the closed position to form the seal within the housing and prevent fluid flow through the vertical bore.

15. The BOP of claim 7, wherein:

the housing comprises a cavity intersecting the vertical bore;

the BOP further comprises a pipe ram assembly movably positionable within the cavity and at least partially movable into the vertical bore of the housing; and the packer assembly is positioned upon an end of the pipe ram assembly to be movable with the pipe ram assembly within the cavity and into the vertical bore of the housing, wherein the packer assembly is configured to form the seal about the object while the BOP is in the closed position.

16. The BOP of claim 7, wherein:

the housing comprises an annular BOP housing; and the elastomeric body comprises an annular body positioned about the vertical bore of the annular BOP housing.

17. The BOP of claim 7, wherein the exterior insert is physically separate from the interior insert.

18. The BOP of claim 7, wherein the interior insert is configured to slide against the exterior insert as the BOP moves toward the closed position.

19. The BOP of claim 7, wherein the exterior insert and the interior insert are configured to rotate circumferentially about the object as the BOP moves toward the closed position.

20. The BOP of claim 7, wherein the interior insert covers the gap while the BOP is in the closed position.

* * * * *